United States Patent [19]

Bailey

[11] Patent Number: 4,998,403

[45] Date of Patent: Mar. 12, 1991

[54] APPARATUS AND METHOD OF COVERING SPANDEX YARN

[75] Inventor: Ray Bailey, Candler, N.C.

[73] Assignee: BASF Corporation, Parsippany, N.J.

[21] Appl. No.: 473,788

[22] Filed: Feb. 1, 1990

[51] Int. Cl.[5] ..... D02G 3/32; D02G 3/36; D01H 7/08; B65H 75/02

[52] U.S. Cl. ..... 57/18; 57/16; 57/59; 57/127.5; 57/129; 242/118.3

[58] Field of Search ..... 57/16–18, 57/129, 127.7, 130, 131, 59, 127.5; 242/118.3, 118.31, 118.32

[56] References Cited

U.S. PATENT DOCUMENTS

| | | | |
|---|---|---|---|
| 4,150,529 | 4/1979 | Northup | 57/18 X |
| 4,232,507 | 11/1980 | Northup et al. | 57/16 |
| 4,435,952 | 3/1984 | Stahlecker et al. | 57/18 |
| 4,484,433 | 11/1984 | Stahlecker et al. | 57/17 X |
| 4,489,541 | 12/1984 | Boling | 242/118.3 X |

*Primary Examiner*—John Petrakes

*Attorney, Agent, or Firm*—Tom R. Vestal; Karen M. Dellerman

[57] ABSTRACT

A method and apparatus are disclosed for wrapping a cover yarn onto an elastic core yarn utilizing a "producer" package directly. The disclosed apparatus eliminates the conventional rewinding step used by garment material manufacturers.

3 Claims, 2 Drawing Sheets

APPARATUS AND METHOD OF COVERING SPANDEX YARN

BACKGROUND OF THE INVENTION

This invention is directed to an efficient manufacture of a covered elastic yarn. Covered elastic yarns are used today in body and leg support garments. The covered elastic yarns typically have a core material of spandex or other elastomer. Usually a single filament or monofilament comprises the core elastic element; however, more than one filament may be used. The wrapping element usually comprises several finer denier filaments, and the filaments are usually made from the same material as the support garment. The elastic yarn normally alternates with conventional inelastic yarns during the course of a material construction. Nylon polymer such as nylon 6 and nylon 6.6 is a popular support garment material for leggings, body stockings and the like.

There are a number of ways of "wrapping" the covering element onto the elastic core. It is known, for example, to pass the core yarn through a filament interlacing device. The covering filaments and core filament are intermingled as a result of a vortex action within the interlacing device and the two elements emerge from the intermixing device in an intermingled condition. During the wrapping operation, the core yarn is usually stretched from 3–5 times its relaxed length. The wrapping yarn is fed tensionless or "overfed" into the intermingling device; therefore, the wrapping or cover yarns tend to wrap around the core yarn and provide a covering therefore.

This invention is to a means for positioning covering filaments around a core yarn in a positive manner. Elastic core filaments are helically wrapped by an inelastic wrapping material. It is known to "single" and "double" wrap elastic yarns from, e.g. U.S. Pat. No. 4,150,529. This particular reference depicts double wrapping. The invention herein may be used in either process.

It is usual for covered yarn manufacturers to wind smaller packages from yarn producer prepared packages and utilize the smaller packages during core wrapping operations. This additional step, especially for higher speed wrapping operations (14,000 rpm and above), is required in view of the conventional producer packages having long winding stroke patterns. As the producer packages are formed, yarn is wound using strokes that generally carry the filament yarn being wound a substantial length of the package per package revolution. Such a package formation creates excessive tension variations when the yarn is being withdrawn in core wrapping operations; thus, the smaller formed packages as depicted in U.S. Pat. No. 4,150,529 and 4,232,507.

U.S. Pat. No. 4,435,952 and 4,484,433 depict the use of producer pirn packages in a wrapping operation for spun staple fibers. These references also depict the binding (wrapping) of a staple fiber in conjunction with the sliver forming process. The binding or wrapping in these references act more as a loose bind around the staple fibers and constitutes less than 5% per weight of the thread structure. Therefore, these references are not representative of a yarn covering process such as used in the formation of covered elastic yarns in support garments. The wrap count in the latter is much higher, permitting the wrapping yarn to substantially cover the elastic core in a relaxed condition.

BRIEF DESCRIPTION OF THE INVENTION

Synthetic yarn producers are now manufacturing synthetic polymer yarn such as nylon 6 and nylon 6.6 yarn in a single process which comprises melt spinning the yarn, processing the yarn to develop its final characteristics and winding the yarn in a single step process. Further, with finer textile yarns (e.g. 150 denier and below) it has been found that several packages of yarns spun from different spinnerettes can be wound onto a common winding arbor, thus manufacturing several packages at the same time on the arbor. Advantageously for the purpose of this invention, these packages have a smaller dimension across the face of the package than previously prepared producer yarn packages. It is recognized in this invention that the smaller face dimension packages may be used directly in yarn covering apparatus, thus eliminating the need for the additional package forming operation presently used by the manufacturers of covered elastic yarns. The invention further entails the use of adapters for the core winding machinery which permit utilization directly of the producer packaging.

DETAILED DESCRIPTION OF THE FIGURES

Figure 1:
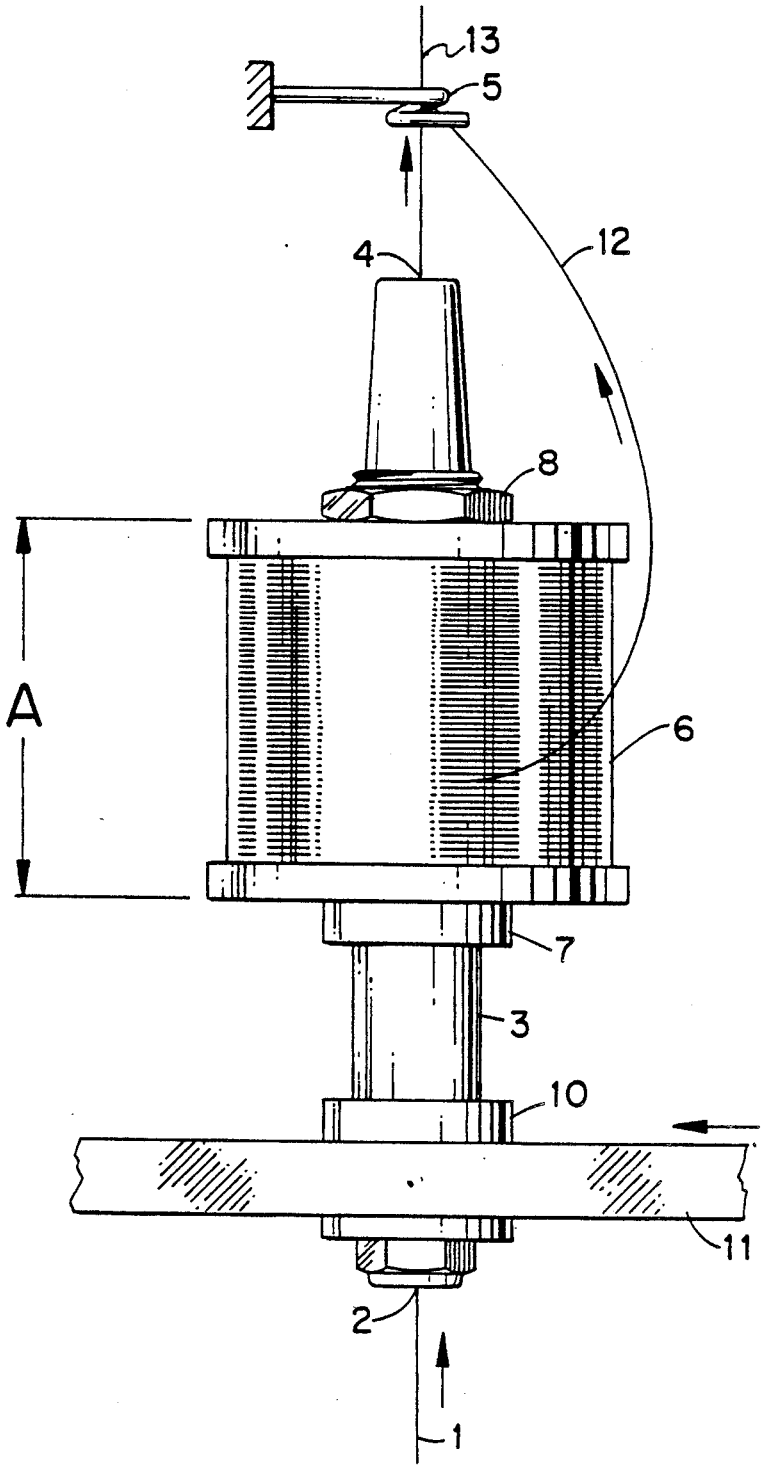
FIGURE 1 (PRIOR ART)
FIG. 1 is a description of the prior art device for covering yarns onto an elastic core.

As depicted in FIG. 1 representing the prior art process, an elastomeric yarn or spandex yarn 1 is fed through an entrance 2 in a rotating arbor 3. The spandex yarn 1 exits the rotating arbor 3 through an exit opening 4 and then is fed further through the processing operation through an eyelet guide 5.

A package of covering yarn 6 is positioned onto the rotating arbor 3 by appropriate means including, in this particular example, a lock nut 7 and securing nut 8. As stated, the package is one rewound from a conventional yarn producer package onto a smaller bobbin for unwinding. The rotating arbor is positioned to a frame (not shown) through a bearing mount 10 and is rotated by a belt 11 which contacts a surface of the arbor thus producing rotation of the arbor.

As the yarn 12 from package 6 is rotated along with the arbor it is wrapped around the spandex core yarn 1 being fed up through the center of the arbor. The amount of wrap and coverage of the core yarn is a result of the rotational speed of the package 6 and the linear speed of the core element 1. The resultant yarn 13 comprises a central core filament having covering filaments wrapped in a positive manner around the core yarn, thus providing a complete coverage of the core yarn by the wrapped yarn.

The height A of the package 6 is maintained usually 4" and below for the reasons stated above relative to variations in tension.

Figure 2:
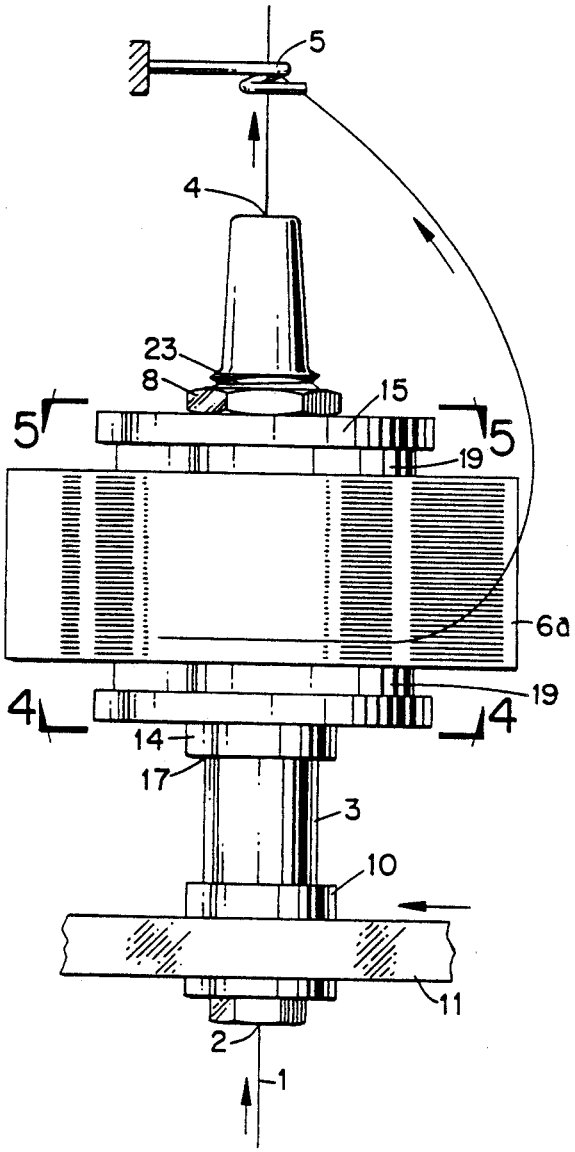
FIG. 2 is a device of the invention utilizing the larger producer package.
Figure 3:
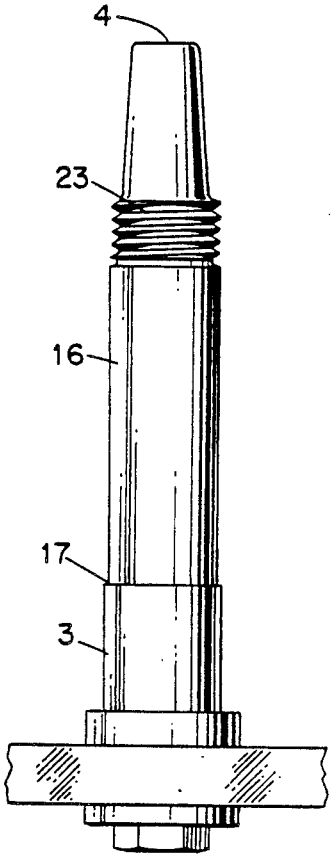
FIG. 3 is a side view of the package arbor used in the invention.
Figure 4:
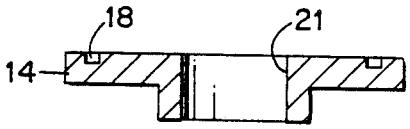
FIGS. 4 and 5 represent adaptor plates to be used on the arbor of FIG. 3.
Figure 5:
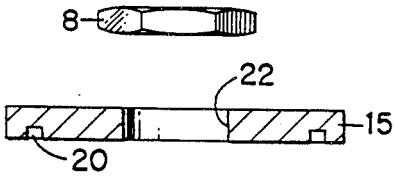

In FIG. 2 the yarn wrapping arbor is shown utilizing the present invention. A producer "flat" package 6A is shown mounted on arbor 3 in FIG. 2 through the use of adapter bottom plate 14 and top flange plate 15. The "flat" package nominally is 110 centimeters (4+") or less across the face for purposes of this invention. Adapter plate 14 fits over the package section 16 and rests firmly upon ledge 17 formed on the arbor surface. Both adaptor plates 14 and 15 have circumferential grooves 18 and 20, respectively, which circumferential grooves are for receiving the ends of package tube support 19. The inner diameters 21 and 22 of the adaptor plates 14 and 15, respectively, are slip fits over section 16 of arbor 3.

The utilization of the present invention is simple and effective in that it provides a means of directly attaching a producer package to a conventional yarn wrapping machine. In operation the adaptor 14 is first placed, circumferential groove side up, over the arbor 3 down to sitting ledge 17. Package 6A is then placed in position on the adaptor plate 14 with the ends of the tube support 19 fitting into the circumferential groove 18. Adaptor plate 15 is then placed over arbor 3 down onto the package section 16, the end of tube support 19 fitting into groove 20 in the adapter plate. A nut 8 is then placed over the end of arbor 3 and tightened through the use of screw threads. Package 6A is thereby locked into place for operation. Wrapping of the elastic yarn can be accomplished thereafter in a conventional manner.

I claim:

1. An adapter apparatus for an elastic yarn wrapping machine having an arbor for securing the wrapping yarn package against the step ledge, the adapter apparatus consisting essentially of:

(a) a lower circuit plate having a center opening comprising substantially a slip fit over a package section of the arbor, but smaller than the step ledge, said lower plate having a circular groove in one face for receiving the end of the tube support for the wrapping yarn package;

(b) an upper circuit plate having a center opening comprising substantially a slip fit over a package section of the arbor; and (c) means for securing the lower plate, a wrapping yarn package wound on a tube support and the upper plate in position on said arbor for unwinding the wrapping yarn.

2. The adapter apparatus of claim 1 wherein the means for securing comprises a section of the arbor above the package section having male screw threads on the arbor surface, and a securing nut having matching female screw threads wherein the upper plate center opening is smaller in diameter than the outer diameter of said securing nut.

3. In a method of manufacturing covered elastomeric yarns, the steps of:

(a) forming a plurality of yarn packages having a face dimension of four inches or less, the filaments on the yarn packages being fully processed into relatively inelastic yarn;

(b) placing one yarn package onto a yarn wrapping arbor and between the adapter plates of claim 1, securing the plates; and thereafter (c) rotating the arbor and feeding the inelastic yarn onto an elastic yarn moving through the arbor.

* * * * *